US005867944A

United States Patent [19]

Attaway

[11] Patent Number: 5,867,944

[45] Date of Patent: Feb. 9, 1999

[54] EXPANDABLE DOWNSPOUT

[75] Inventor: Julian J. Attaway, Marietta, Ga.

[73] Assignee: MM Systems Corporation, Tucker, Ga.

[21] Appl. No.: 745,500

[22] Filed: Nov. 12, 1996

[51] Int. Cl.[6] ..... E04D 13/08

[52] U.S. Cl. ..... 52/16; 405/119

[58] Field of Search ..... 405/118, 119, 405/120, 121; 52/11, 12, 16; 248/48.1, 48.2

[56] References Cited

U.S. PATENT DOCUMENTS

| | | | |
|---|---|---|---|
| 2,373,394 | 4/1945 | Hall | 52/16 |
| 3,076,669 | 2/1963 | Schlein | 52/16 |
| 5,220,755 | 6/1993 | Roles | 52/16 |
| 5,358,006 | 10/1994 | Sweers | 405/119 X |
| 5,533,303 | 7/1996 | Harvey | 52/16 |

*Primary Examiner*—Tamara L. Graysay
*Assistant Examiner*—Frederick L. Lagman
*Attorney, Agent, or Firm*—Needle & Rosenberg, P.C.

[57] ABSTRACT

A downspout in which a section is formed of a material that is substantially elastic and which forms an expandable face member that flexes away from the center of the downspout if the water in it freezes and, when the rainwater thaws, the elastic material returns to substantially its original dimension. It is also preferred that the expandable face member include two longitudinally-extending channels that are substantially V-shaped in cross section. The channels allow for greater outward expansion of the expandable face member, which further reduces the chances of permanent deformation and decreases the stresses on the connection between the expandable face member and the non-flexible portion of the downspout.

23 Claims, 4 Drawing Sheets

EXPANDABLE DOWNSPOUT

BACKGROUND OF THE INVENTION

1. Field of the Invention

The present invention relates to a downspout having a portion that is constructed of a flexible, elastic material that expands if rainwater therein freezes and then returns to substantially its original size when the water later thaws and contracts.

2. Background Art

The use of a downspout is known in the art to interconnect a gutter or other rainwater collecting device at the top of a building to the ground or to a drainage system located below the top of the building. The downspout is usually disposed vertically along the building and the rainwater is directed from the gutter, through the upright or vertically-disposed downspout, and to the ground.

Unfortunately, the downspout can sometimes become clogged so that the flow of the rainwater is blocked or restricted. This often occurs at the lower end of the downspout where dirt and leaves collect or another obstruction exists. The result is that water accumulates in the downspout.

For example, packed snow or ice can clog the lower end of a downspout during periods of cold weather so that water cannot flow out of the downspout. At the opposite end of the downspout, however, snow on the roof of the building melts as heat escapes from within the building. This water, which is slightly above its freezing temperature, drains into the downspout and cannot exit from the lower end. The water then re-freezes and expands inside the downspout. If the freezing water cannot expand vertically along the longitudinal length of the downspout, it expands outwardly, which causes a portion of the downspout to split or deform. The damaged downspout is unsightly and must be replaced.

Thus, there is a need in the art for a downspout that elastically expands if the rainwater in it freezes and then returns to substantially its same size when the water subsequently thaws and contracts.

SUMMARY OF THE INVENTION

The present invention comprises a downspout in which a section is formed of a material that is substantially elastic. The elastic material, or expandable face member, flexes away from the center of the downspout if there is an obstruction with the downspout passage adjacent the expandable section. The most common obstruction would be frozen rainwater. When the rainwater thaws, the elastic material returns to substantially its original dimension.

In addition to the expandable face member being formed of an elastic material, it is also preferred that the expandable face member include two longitudinally-extending channels that are substantially V-shaped in cross section. The channels allow greater outward expansion of the expandable face member, which further reduces the chances of permanent deformation and decreases the stresses on the connection between the expandable face member and the non-flexible portion of the downspout.

Another advantage of the present invention is that it allows the expandable face member to be installed when construction of the building is almost complete. Prior to the present invention, projects were often delayed while waiting for the downspouts to be installed. For example, the expandable face member of the present invention can be installed after the brickwork is finished, unlike the prior art in which the entire downspout had to be installed prior to beginning to lay the brickwork.

DETAILED DESCRIPTION OF THE INVENTION

The present invention is more particularly described in the following examples that are intended as illustrative only since numerous modifications and variations therein will be apparent to those skilled in the art. As used in the specification and in the claims, "a" can mean one or more, depending upon the context in which it is used.

Figure 1:
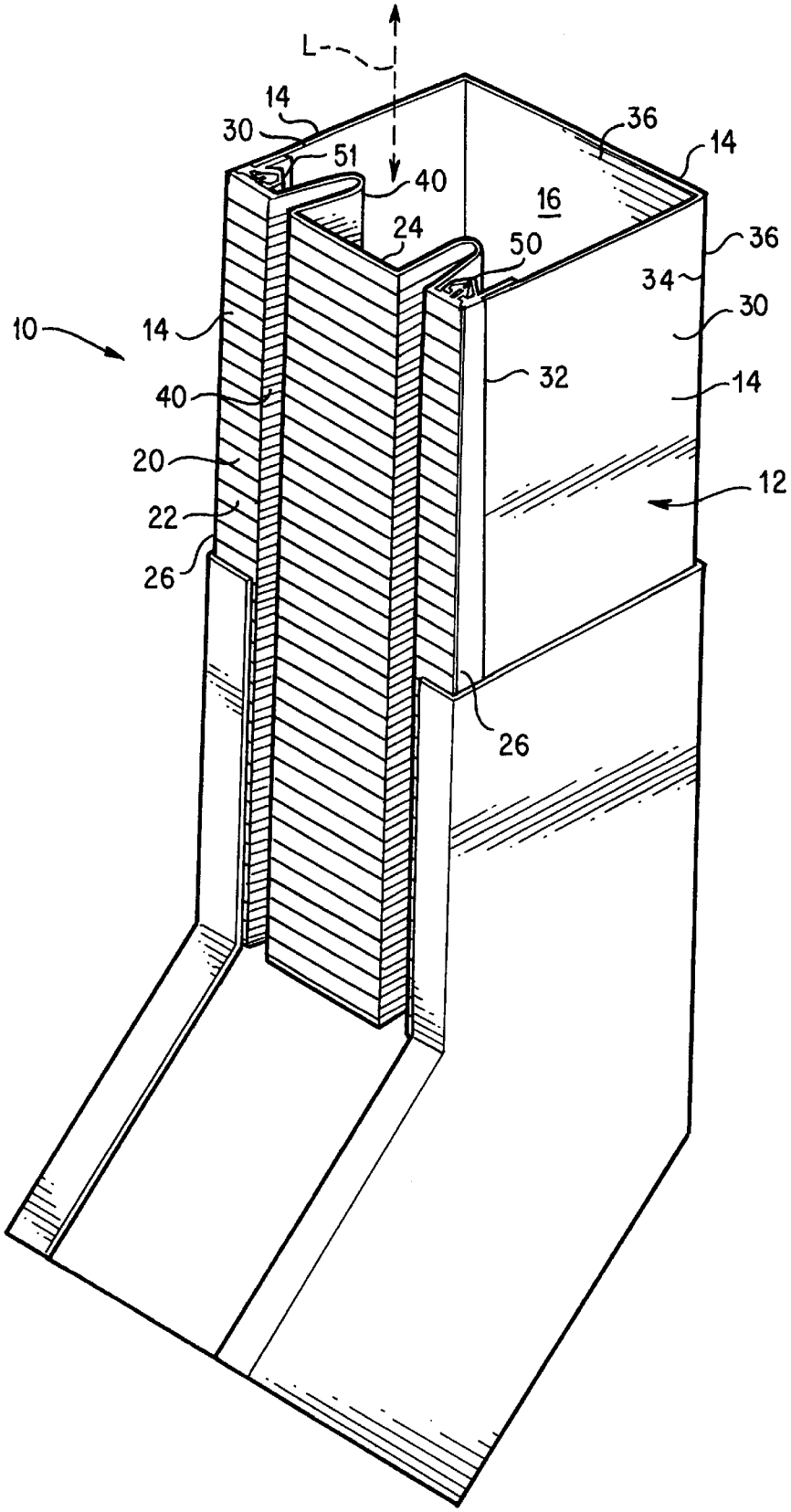
FIG. 1 is a perspective view of a first, preferred embodiment of the expandable downspout of the present invention.
Figure 2:
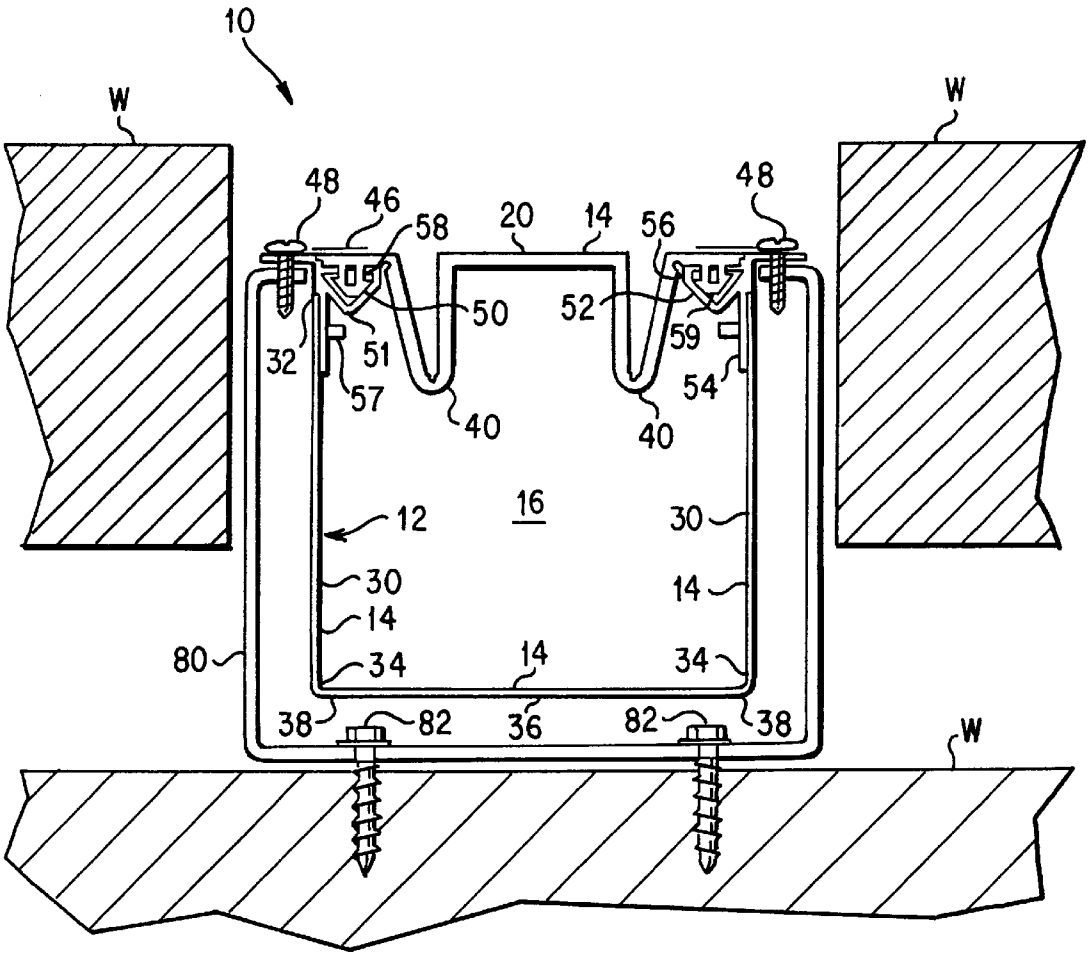
FIG. 2 is a horizontal cross-sectional view of a portion of the expandable downspout of FIG. 1 showing the mounting means attaching the downspout to a building.

Referring first to FIGS. 1 and 2, the present invention comprises an expandable downspout 10 for receiving rainwater therein. The downspout 10 comprises an enclosed body portion 12 having a longitudinal axis L and a means for expanding at least a section of the body portion 12 laterally outwardly away from the longitudinal axis L of the body portion 12.

Preferably, the body portion 12 comprises a plurality of juxtaposed, longitudinally-extending faces 14 circumscribing the longitudinal axis L of the body portion 12 and defining an enclosed passage 16. The passage 16 is adapted to contain and direct the rainwater or other fluid from a desired inlet, for example, a gutter (not shown), longitudinally through the passage 16 to a desired outlet, for example, a drainage system (not shown) or the ground.

The expanding means comprises at least a section of one face 14 of the body portion 12 being formed of a material that is substantially elastic, or flexible, which is the expandable face member 20, to allow lateral outward expansion of that section of the downspout 10 when the rainwater therein freezes and expands. After the rainwater thaws and contracts, the elastic material of the expandable face member 20 returns substantially to its original dimension. Preferably, the flexible material is an elastomeric material or selected from the group consisting of plastic, rubber, EPDM (ethylene-propylene diene monomer), neoprene, silicone, or a mixture thereof.

The faces 14 of the longitudinally-extending body portion 12 further comprise two side members 30 and a back member 36 disposed therebetween. Each side member 30 has a first edge 32 and an opposed second edge 34, and the back member 36 has two laterally opposed edges 38. Each edge 38 of the back member 36 abuts in the second edge 34 of the adjacent side member 30. The side members 30 and back member 36 are preferably formed of aluminum.

The expandable face member 20 has an outwardly facing front side 22, an opposite rear side 24, and two laterally opposed edges 26, in which each edge 26 is disposed adjacent the first edge 32 of one side member 30. The downspout 10 also includes a means for attaching each edge 26 of the expandable face member 20 to the adjacent first edge 32 of the side member 30. Thus, the expandable face member 20 and the members 30, 36 form a substantially enclosed body portion 12 defining a passage 16 therein through which the rainwater traverses.

In addition to the expandable face member 20 being formed of an elastic material, it is also preferred that the expanding means further comprises at least one longitudinally-extending channel 40 in at least a portion of the expandable face member 20. Each channel 40 is substantially V-shaped in cross section. This allows greater outward expansion of the expandable face member 20, which decreases the stresses on the attaching means and further reduces the chance of permanent deformation.

Alternatively, the expanding means may comprise only the longitudinally-extending channels being formed of an elastic material and the remainder of the downspout being a formed of a non-elastic material (not shown). That is, the channels are formed of an elastic material and the rest of the face member in which it is disposed and the other face members are formed of a non-elastic material.

Figure 3:
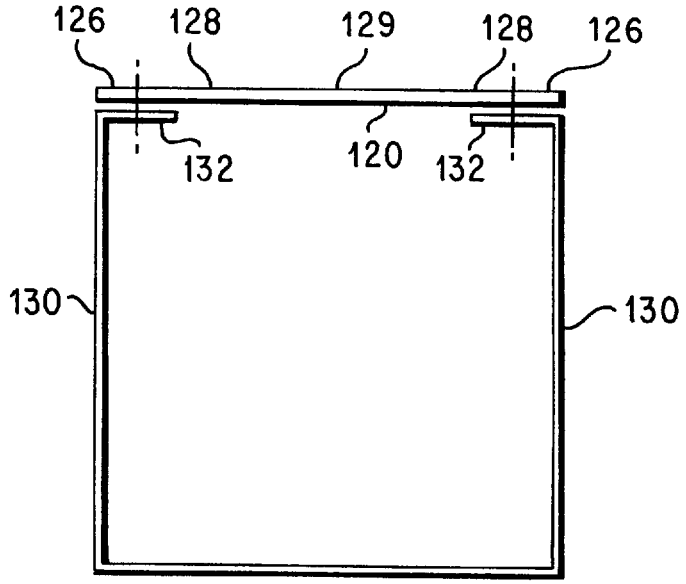
FIG. 3 is a horizontal cross-section view a second embodiment of the expandable downspout in which the expandable face member is formed of a dual durometer.
Figure 4:
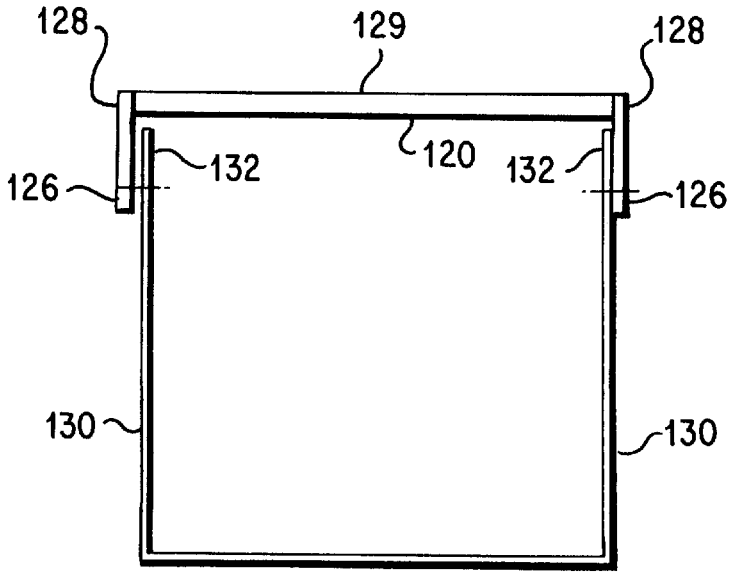
FIG. 4 is a horizontal cross-sectional view of an alternate embodiment of the expandable downspout shown in FIG. 3.

As shown in FIGS. 3 and 4, a second embodiment of the present invention comprises the expandable face member 120 being formed of a dual durometer in which a portion 128 of the dual durometer adjacent both its two laterally opposed edges 126 is rigid and the portion 129 of the dual durometer intermediate each of the edges 126 is flexible. However, these alternate embodiments are less desired than the preferred embodiment shown in FIGS. 1 and 2, in which the expandable face member 20 is formed of an elastic material and has at least one longitudinally-extending channel 40. Regardless of the embodiment used, however, the expanding means advantageously allows frozen rainwater, or ice, within the passage 16 to expand laterally outwardly without splitting or permanently deforming the downspout 10.

As one skilled in the art will appreciate, no obstructions, such as a portion of the building, should be in front of the expandable face member 20 so as to block the outward expansion of the face member 20 and, accordingly, undermine its function. Depending on the building design, it may be desirable to place the downspout 10 within a niche in the building so that the flexible face member 20 is substantially flush with the outside building wall W or, as shown in FIG. 2, recessed within the niche. As one skilled in the art will also appreciate, the flexible face member 20 can be made in different colors to allow the architect to obtain a desired building appearance.

Referring now to FIGS. 1 and 2, a right or an acute angle is formed between each side member 30 and the back member 36 at the intersection thereof so that the body portion 12 is substantially U-shaped in cross section. Alternatively, the side members 30 and the back member 36 can be arcuate in cross section so that the body portion 12 has a substantially a semicircle cross-section (not shown).

Still referring to FIGS. 1 and 2, the preferred attaching means of the present invention comprises a connecting member 50 extending from the rear side 24 of the face member 20 into the passage 16, a means for securably receiving the connecting member 50, and a means for disposing the receiving means within the passage 16. The receiving means preferably comprises a clip 51 having a receiving end 52 and a securing end 54 and the disposing means comprises the securing end 54 of the clip 51 being fixedly attached to a section of the body portion 12, such as by a screw or a rivet 57. The connecting member 50 comprises a fastener 56 having a first end 58 fixedly attached to the rear side 24 of the face member 20 and an opposite second end 59, which is of a size to be complementarily received in and detachably secured to the receiving end 52 of the clip 51.

Preferably, as shown in FIG. 2, the clips 51 are longitudinally disposed along the body portion 12 in pairs so that the securing end 54 of one clip 51 is fixedly attached to one side member 30 of the body portion 12 and the securing end 54 of the other clip 51 of the pair is fixedly attached to the opposed side member 30 of the body portion 12 at the same longitudinal position along the length of the downspout 10. Also, as shown in FIG. 2, the attaching means can further comprise a security strip 46 held by screws 48 disposed over the edges 26 of the face member 20 to reinforce the attachment between the face member 20 and the adjacent side members 30. The screws 48 holding the security strip 46 preferably are theftproof to prevent vandalism and to increase the security of the expandable face member 20.

As illustrated by FIGS. 3 and 4 showing the second embodiment, the attachment means may alternatively be an adhesive—instead of screws or clips—that is disposed between the first edge 32 of each side member 30 and the adjacent edge 26 of the expandable face member 20. An adhesive can also be used in conjunction with screws to attach the face member 20 to the adjacent side member 30. These embodiments, however, are less desirable because it is more difficult to remove and replace the expandable face member 20. As also shown in FIG. 3, the side members 130 may also extend toward each other adjacent their respective first edges 132 to assist in attaching the expandable face member 120 thereto.

An advantage of the attachment means is that it allows the expandable face member to be installed when construction is almost completed. Prior to the present invention, projects were often delayed while waiting for the downspouts to be installed. For example, the expandable face member of the present invention can be installed after the brickwork is finished, unlike the prior art in which the entire downspout had to be installed prior to starting the brickwork.

Figure 5:
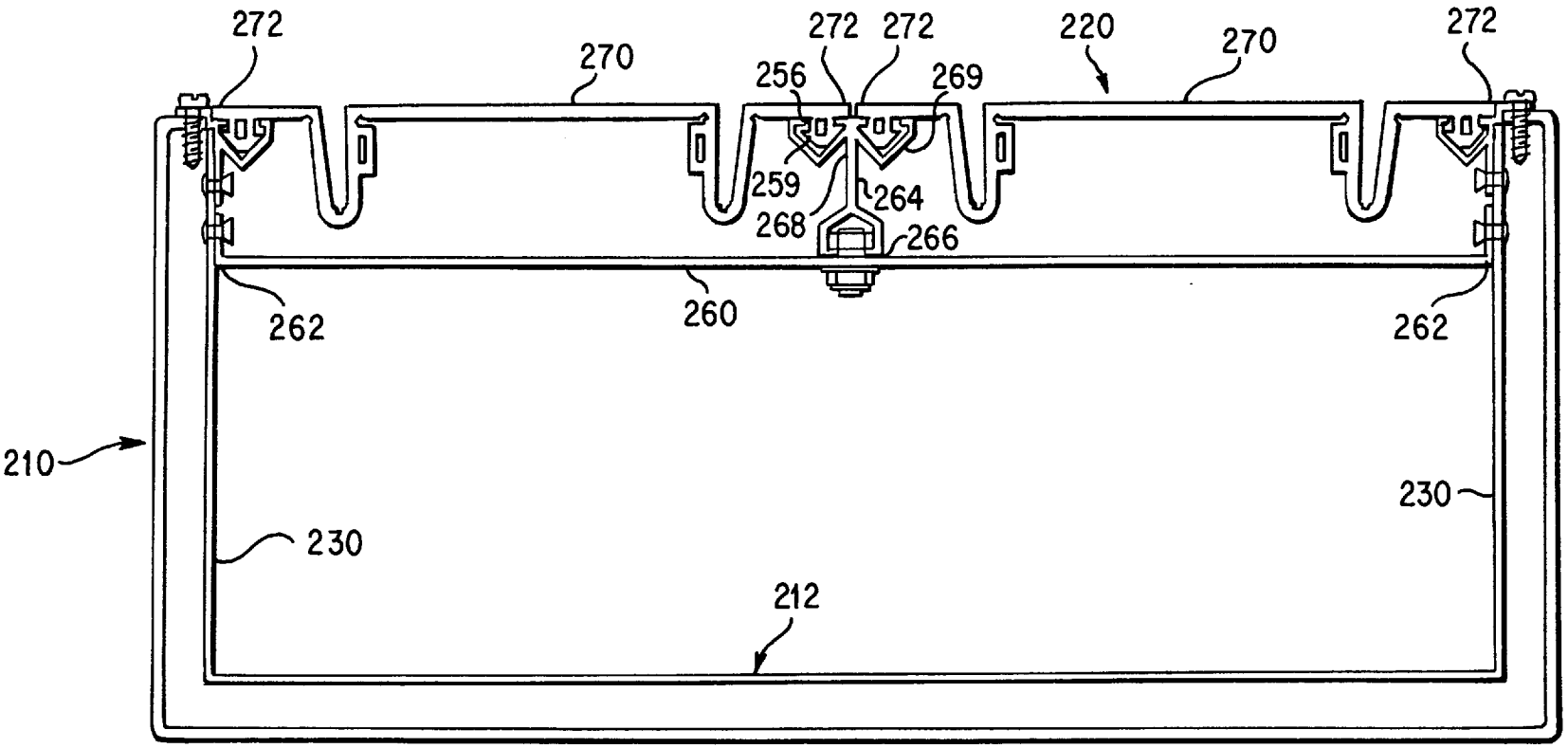
FIG. 5 is a horizontal cross-sectional view of a third embodiment of the expandable downspout of the present invention in which the expandable face member comprises a plurality of face member segments aligned in a side-by-side orientation.

Referring now to FIG. 5 showing a third embodiment of the present invention, the expandable face member 220 of the downspout 210 can comprise a plurality of face member segments 270 in which each face member segment 270 has two longitudinal-extending edges 272. The preferred attaching means of this embodiment comprises at least one laterally-disposed support member 260 having two opposed ends 262 and at least one mullion 264 disposed intermediate the two side members 230. Each end of the support member 260 is fixedly attached to one side member 230 of the body portion 212 and each mullion 264 has a first end 266 fixedly attached to the support member 260 and an opposite second end 268. The second end 268 of the mullion 264 has at least two laterally disposed slots 269 therethrough. Each slot 269 is of a size to receive therein and detachably secure thereto the second end 259 of the fastener 256, which is attached to each face member segment 270. Accordingly, as shown in FIG. 5, the juxtaposed face member segments 270 are laterally aligned and disposed intermediate the side members 230 of the body portion 212. In that way, the outermost longitudinal edges 272 of the face member segments 270 are disposed adjacent to the side members 230 and each of the other longitudinal edges 272 of the face member segments 270 are disposed adjacent one longitudinal edge 272 of the adjacent face member segment 270. Thus, instead of having a single, wide flexible face member, the expandable downspout 210 has at least two face member segments 270 in a side-by-side orientation to extend the desired width of the front side of the downspout 10.

Referring back to FIG. 2, the expandable downspout 10 also preferably further comprises a means for mounting the downspout 10 to a wall W of a building in a substantially upright orientation. The mounting means may comprise at least one bracket 80 detachably securing the downspout 10 to the building wall W. The bracket 80 is fixedly secured to the building, for example, by screws 82, and a portion of the downspout 10 is coupled to the bracket 80. As shown in FIG. 2, the screws 48 that hold the security strip 46 over the edges 26 of the elastic face member 20 also couple the first edge 32 of the side members 30 to a portion the art will also. As one skilled in the art will also appreciate, the cross-sectional area of the bracket 80 is greater than the downspout 10 to accommodate differences in expansion or contraction of the respective components.

Although the present invention has been described with reference to specific details of certain embodiments thereof, it is not intended that such details should be regarded as limitations upon the scope of the invention except as and to the extent that they are included in the accompanying claims.

What is claimed is:

1. An expandable downspout, comprising:

a. an enclosed body portion having a longitudinal axis and defining an enclosed passage therein; and b. means for expanding at least a section of the body portion outwardly away from the longitudinal axis of the body portion when an obstruction is in the passage adjacent the section, wherein, when the body portion expands laterally outwardly as a result of the obstruction, the portion of the passage of the enclosed body adjacent the obstruction remains enclosed.

2. The expandable downspout of claim 1, wherein the body portion comprises a plurality of juxtaposed, longitudinally-extending faces circumscribing the longitudinal axis of the body portion, the faces defining an enclosed passage therein.

3. The expandable downspout of claim 2, wherein the expanding means comprises at least one face of the body portion being formed of a material which is substantially elastic so as to allow outward expansion thereof when the obstruction is within the passage and wherein the material returns substantially to its original dimension when the obstruction is removed therefrom.

4. The expandable downspout of claim 3, wherein the elastic material is selected from the group consisting of plastic, rubber, EPDM, neoprene, silicone, or a mixture thereof.

5. The expandable downspout of claim 3, wherein the elastic material is an elastomeric material.

6. The expandable downspout of claim 3, wherein the expanding means further comprises at least one channel longitudinally extending along at least a portion of the face of the body portion formed of the elastic material.

7. The expandable downspout of claim 3, wherein the channel is substantially V-shaped in cross section.

8. The expandable downspout of claim 2, wherein the expanding means comprises at least one longitudinally-extending channel constructed of an elastic material in at least a portion of one face.

9. The expandable downspout of claim 8, wherein the channel is substantially V-shaped in cross section.

10. An expandable downspout, comprising:

a. a longitudinally-extending body portion having two side members and a back member disposed therebetween, wherein each of the side members has a first edge and an opposed second edge, and wherein the back member has two laterally opposed edges, each edge of the back member terminating in the second edge of the adjacent side member;

b. a longitudinally-extending, laterally expandable face member having two laterally opposed edges, each edge of the face member being disposed adjacent the first edge of one side member; and c. means for attaching each edge of the face member to the adjacent first edge of the side member so that the face member and the body portion form a substantially enclosed body portion of the downspout, the enclosed body portion defining a passage therein, wherein when the face member laterally expands outwardly as a result of an obstruction within the passage, the edges of the face member remain stationarily attached to the respective edges of the side member so that the enclosed body portion formed by the face member and the body portion remains enclosed adjacent the obstruction.

11. The expandable downspout of claim 10, wherein the face member is constructed of an elastomeric material.

12. The expandable downspout of claim 10, wherein the face member constructed of a material selected from the group consisting of plastic, EPDM, neoprene, silicone, or a mixture thereof.

13. The expandable downspout of claim 10, wherein the face member further comprises at least one longitudinally-extending channel in at least a portion of the face member.

14. The expandable downspout of claim 13, wherein the channel is substantially V-shaped in cross section.

15. The expandable downspout of claim 10, wherein an angle is formed between each side member and the back member at the intersection thereof, whereby the body portion is substantially U-shaped in cross section.

16. The expandable downspout of claim 10, further comprising means for mounting the downspout to a wall of a building in a substantially upright orientation.

17. The expandable downspout of claim 16, wherein the mounting means comprises at least one bracket detachably securing the downspout to the wall of the building.

18. An expandable downspout, comprising:

a. a longitudinally-extending body portion having two side members and a back member disposed therebetween, wherein each of the side members has a first edge and an opposed second edge, and wherein the back member has two laterally opposed edges, each edge of the back member terminating in the second edge of the adjacent side member;

b. a longitudinally-extending, laterally expandable face member having two laterally opposed edges, each edge of the face member being disposed adjacent the first edge of one side member wherein the face member has a front side and an opposite rear side; and c. means for attaching each edge of the face member to the adjacent first edge of the side member so that the face member and the body portion form a substantially enclosed body portion of the downspout, the enclosed body portion defining a passage therein, and wherein the attaching means comprises:

i. a connecting member extending from the rear side of the face member into the passage in the enclosed body portion;

ii. means, disposed within the passage, for securably receiving the connecting member; and iii. means for disposing the receiving means within the passage.

19. The expandable downspout of claim 18, wherein the receiving means comprises a clip having a receiving end and a securing end, wherein the disposing means comprises the securing end of the clip being fixedly attached to a portion of the body portion, and wherein the connecting member comprises a fastener having a first end fixedly attached to the rear side of the face member and an opposite second end which is of a size to be complementarily received in and detachably secured to the receiving end of the clip.

20. The expandable downspout of claim 19, wherein a plurality of the clips are longitudinally disposed along the body portion in pairs so that the securing end of one clip of the pair is fixedly attached to one side member of the body portion and the securing end of the other clip is fixedly attached to the opposed side member of the body portion at the same longitudinal position along the downspout.

21. The expandable downspout of claim 19, wherein the face member comprises a plurality of longitudinally-extending face member segments, each face member segment having two longitudinal edges, and wherein the attaching means further comprises:

a. at least one support member being laterally disposed and having two opposed ends, each end being fixedly attached to one side member of the body portion; and b. at least one mullion disposed intermediate the two side members, each mullion having a first end fixedly attached to the support member and an opposite second end, the second end having at least two laterally disposed slots therethrough, each slot being of a size to receive therein and detachably secure thereto the second end Of one fastener attached to each face member segment, wherein a plurality of juxtaposed face member segments are laterally aligned and disposed intermediate the side members of the body portion so that the outermost longitudinal edges of the face member segments are disposed adjacent to the side members and each of the other longitudinal edges of the face member segments are disposed adjacent one longitudinal edge of the adjacent face member segment.

22. An expandable downspout comprising:

a. a longitudinally-extending body portion having two side members and a back member disposed therebetween, wherein each of the side members having a first edge and an opposed second edge, and wherein the back member has two laterally opposed edges, each edge of the back member terminating in the second edge of the adjacent side member;

b. a longitudinally-extending, laterally expandable face member has two laterally opposed edges, each edge of the face member being disposed adjacent the first edge of one side member; and c. means for attaching each edge of the face member to the adjacent first edge of the side member so that the face member and the body portion form a substantially enclosed body portion of the downspout, the enclosed body portion defining a passage therein, wherein the attaching means is an adhesive disposed intermediate the first end on the side members and the adjacent edge of the face member.

23. An expandable downspout, comprising:

a. a longitudinally-extending body portion having two side members and a back member disposed therebetween, wherein each of the side members has a first edge and an opposed second edge, and wherein the back member has two laterally opposed edges, each edge of the back member terminating in the second edge of the adjacent side member;

b. a longitudinally-extending, laterally expandable face member having two laterally opposed edges, each edge of the face member being disposed adjacent the first edge of one side member, wherein the face member is made from a dual durometer in which a portion of the dual durometer adjacent the two laterally opposed edges thereof is rigid and a portion of the dual durometer intermediate each of the edges is flexible; and c. means for attaching each edge of the face member to the adjacent first edge of the side member so that the face member and the body portion form a substantially enclosed body portion of the downspout, the enclosed body portion defining a passage therein.

* * * * *